United States Patent [19]

Schwebel et al.

[11] Patent Number: 4,693,463

[45] Date of Patent: Sep. 15, 1987

[54] APPARATUS FOR THE LATERAL REGISTRATION OF SHEETS

[75] Inventors: Adolph Schwebel, Offenbach am Main; Obertshausen/Hausen, both of Fed. Rep. of Germany

[73] Assignee: Mabeg Maschinenbau GmbH & Company, Offenbach am Main, Fed. Rep. of Germany

[21] Appl. No.: 846,873

[22] Filed: Apr. 1, 1986

[30] Foreign Application Priority Data

Apr. 1, 1985 [DE] Fed. Rep. of Germany ..... 3511897

[51] Int. Cl.[4] ..... B65H 9/00

[52] U.S. Cl. ..... 271/236; 271/239; 271/250; 271/253

[58] Field of Search ..... 271/226, 234, 236–238, 271/239, 240, 248, 250–252, 253

[56] References Cited

U.S. PATENT DOCUMENTS 2,165,172 7/1939 Backhouse ..... 271/252

4,591,143 5/1986 Jeschke ..... 271/236 X

FOREIGN PATENT DOCUMENTS 617605 8/1935 Fed. Rep. of Germany ..... 271/250

*Primary Examiner*—Richard A. Schacher

*Attorney, Agent, or Firm*—Leydig, Voit & Mayer

[57] ABSTRACT

The invention relates to apparatus for the lateral registration and registration in the feed direction of sheets which are fed in a sheet stream across a feed table to a sheet treating machine, e.g. a printing press. They stretch out the sheet transversely to the feed direction. The apparatus includes two suction plates arranged at a distance one from another at right angles to the feed direction, which are each respectively drivable in rotation about an axis. By use of suction openings which can be subjected to suction, the respective frontmost sheet of the sheet stream can be grasped in the region of its front edge and moved to bring its side edge to lie against a side stop and to bring its front edge to lie against a front stop. In accordance with the invention, one suction plate is drivable rotatably in a first rotational sense and the second suction plate in the opposite rotational sense. The suction openings of one suction plate can be subjected to greater suction than the suction openings of the other plate, so that the correct desired stretching of the sheet and registration against front stops an a side stop is achieved.

14 Claims, 6 Drawing Figures

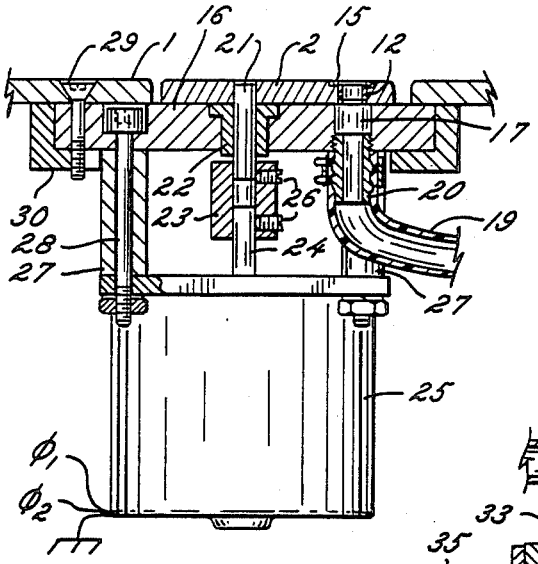
FIG. 4
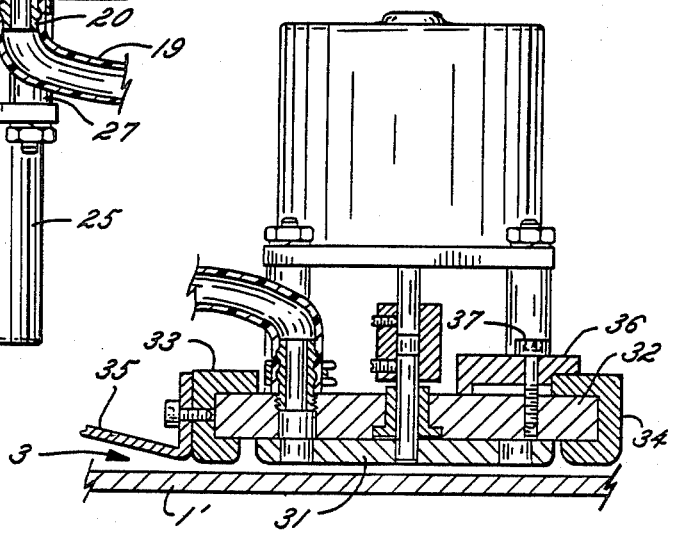
FIG. 5
FIG. 6
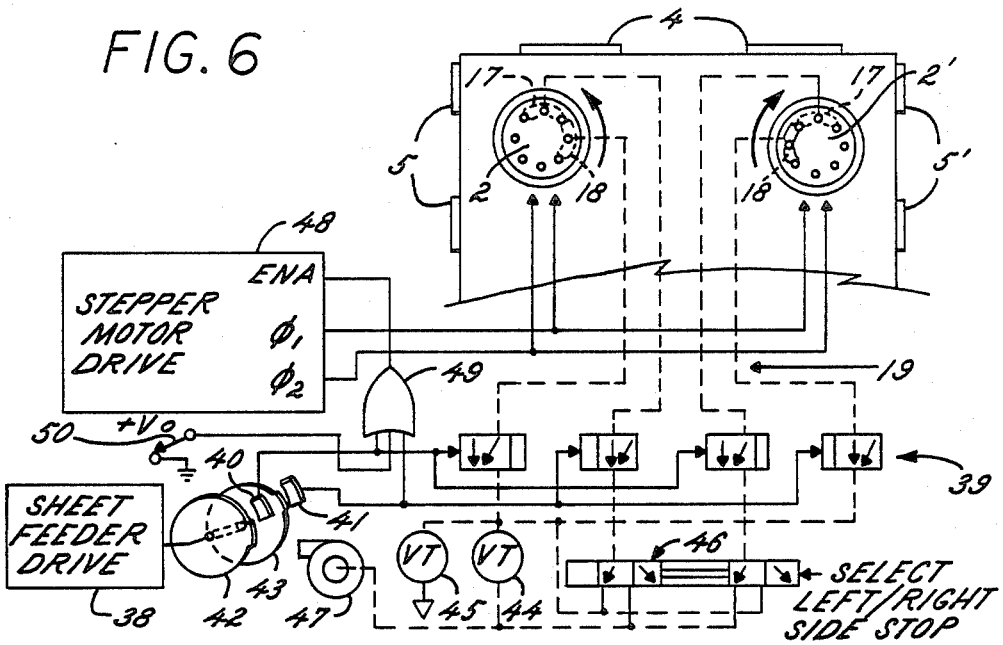

APPARATUS FOR THE LATERAL REGISTRATION OF SHEETS

FIELD OF THE INVENTION:

This invention relates to apparatus for the lateral registration and/or registration in the feed direction of sheets of a sheet stream fed via a feed table to a sheet treating machine.

BACKGROUND TO THE INVENTION:

Apparatus for laterally registering sheets on the feed table of a sheet treatment machine, e.g. a printing press, is known in which two suction plates are arranged at a distance one from another at right angles to the feed direction, which can each be rotatably driven about an axis arranged perpendicular to the feed table. The surfaces of the plates are provided with suction openings which can be subjected to suction air, and the plates act to grasp the respective frontmost sheet of the sheet stream in the region of its edge and move it so that its side edge comes to lie against a side stop and/or its front edge comes to lie against a front stop.

In such types of apparatus it is known to drive the suction plates in the same rotational direction and to subject them to the same suction force. Since an absolutely equivalent running of the beginning, ending and speed of the turning movement of both suction plates, as well as absolutely even suction during the whole registration process, is not possible, or only possible with unacceptably high outlay, particularly with thin and large surface area sheets, bending, buckling and creasing arise and accordingly damage to the sheets arises during the registration process.

SUMMARY OF THE INVENTION;

It is a principal object of the invention, accordingly, to provide apparatus of the type noted above which, using simple means, enables registration with the avoidance of bending, buckling and creasing of the sheets.

In accordance with the invention, in a system of the type described, one suction plate is drivable rotationally in a first rotational sense and the second suction plate is drivable in the rotational sense opposite to the rotational sense of the first suction plate, wherein in each case, the suction openings located seen in the feed direction essentially in the rear quadrants turned away therefrom or the suction openings located in the feed direction essentially in the front facing quadrants can be subjected to suction air. By this construction, the respective sheet to be registered is always tensioned by the suction plates moving in the opposed rotational senses transversely to the feed direction. Furthermore, this leads to a flattening and stretching as well as a holding down of the front edge of the sheet, so that this is fed tensioned and without any arching to the front stops of the sheet treating machine.

Since the apparatus moves the sheets in the feed direction, any special means for feeding the sheets to the front stops of the sheet treating machine can be dispensed with.

The suction openings at the first suction plate can be subjected to suction air of greater suction force than the suction openings of the second suction plate. The higher suction force to the first suction plate thereby holds the sheet firmly and moves it towards the stop while because of the smaller suction force simultaneously the sheet is moved sideways against the resistance caused by the second suction plate which tensions the sheet laterally. The forward movement of the sheet however remains at both suction plates the same. For lateral registration the first suction plate can be arranged closer to the side stop than the second suction plate, wherein the first suction plate is drivable in a rotational sense which moves the sheet to the side stop. Preferably, a side stop is arranged along each side edge of the frontmost sheet, and the suction air loading of the suction plates can be reversed.

Thereby the sheets can be registered according to choice either against one of the side stops or to lie against the other side stop. The respective frontmost sheet can, during a quarter turn of the suction plate, be grasped by this and is feedable to lie against the side stop. If the grasped sheet is first movable with a forward component directed essentially in the feed direction and then with a lateral component essentially directed towards the side stop, then the forward component can be used to align the sheet against front stops.

The suction plates can be drivable rotationally both stepwise and permanently, wherein it is particularly favourable if they are drivable in synchronism. If the suction plates are continuously driven, then at least one of the suction plates can be subjected to suction air in time with the sheet treating machine. This is of advantage in particular for side registration of the sheets. If in this case only one suction plate can be subjected to suction air in time, then this is the suction plate closer to the side stop, while the other permanently turning suction plate is also permanently subjected to suction air.

It is possible that the suction plates are arranged above the feed table. If however the suction plates are arranged below the feed table, then they cannot get in the way.

In order to enable matching both to sheet quality and also to sheet size, the suction plates can be arranged adjustably transversely to the feed direction. In this connection, it is particularly advantageous if the suction plates are arranged adjustably independently one of another transversely to the feed direction. Thereby the suction plates can always be so arranged that they grasp the respective sheets in each case in the region of a side edge, so that the sheet is tensioned essentially over its entire width.

BRIEF DESCRIPTION OF THE DRAWINGS:

Other objects and advantages of the present invention will become apparent upon reading the following detailed description and upon reference to the drawings in which:

FIG. 4 is a side view in partial section along line 4—4 in FIG. 3;

FIG. 5 is a side view, in partial section, showing a suction plate mounted above a sheet feed table and showing means to adjust the position of the suction plate transversely to the feed direction; and FIG. 6 is a schematic diagram of a control system for synchronizing the rotation of two suction plates to a sheet feeder drive and selectively applying suction to either register the sheet against the left-hand side stops or right-hand side stops.

Figure 1:
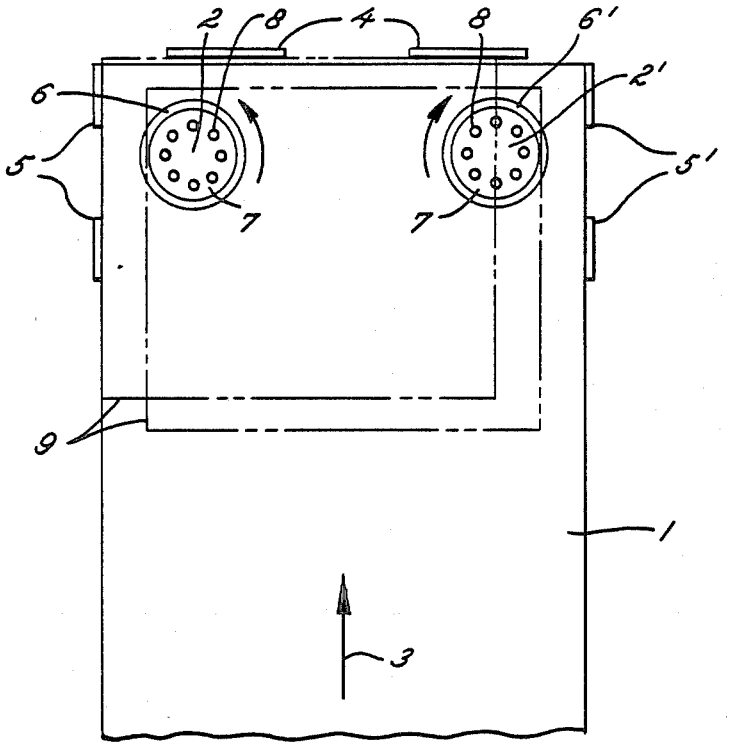
FIG. 1 is a plan view of a sheet feed table employing the present invention.

While the invention is susceptible to various modifications and alternative forms, specific embodiments thereof have been shown by way of example in the drawings and will herein be described in detail. It should be understood, however, that the intention is not to limit the invention to the particular forms disclosed, but, on the contrary, the intention is to cover all modifications, equivalents, and alternatives falling within the spirit and scope of the invention as defined by the appended claims.

DETAILED DESCRIPTION OF THE PREFERRED EMBODIMENTS:

Turning now to the drawings, there is shown in FIG. 1 a feed table 1, the table plate of which has circular apertures 6, 6' in which two suction plates 2, 2' are arranged in such a way that their upwardly directed plate surfaces 7 are flush with the feeding plane of the table plate.

In another embodiment, the suction plates can also be arranged above the feed table, wherein the surfaces of the plates towards the table plate are located at a distance above the table plate which is somewhat greater than the sheet thickness. This alternative is further described below in connection with FIG. 5.

The suction plates 2, 2' are arranged relative to one another at a distance at right angles to the feed direction 3. They are located in the region of the front stops 4 arranged at the end of the feed table 1.

On each long side of the feed table 1, there are arranged side stops 5, 5'. The suction plates 2, 2' which are drivable about their vertical axes are provided with suction openings 8 which are evenly distributed about an arc on the plate planes 7 of the suction plates 2, 2' and which debouch outwardly. The suction openings 8 are selectively connected to a source of suction from the underside of the feed table 1. In fact on the suction plate 2 the suction openings 8 located essentially in the right hand front quarter of the arc and in the case of suction plate 2' the suction openings 8' located essentially on the left hand front quarter of the arc can be subjected to suction.

The suction plates 2, 2' are continuously drivable rotationally turning in synchronism. Thereby the respective frontmost sheet of a sheet stream fed in the feed direction 3 on the feed table 1 is grasped in the region of its front edge by the suction plates 2, 2' and in a first part of a feed movement is moved essentially in the feed direction 3 to lie against the front stops 4. Since the suction air openings 8 of the suction plate 2 are subjected to greater suction force than the suction air openings 8 of the suction plate 2', there results in the further feed movement a movement of the sheet 9 towards the side stops 5. In this connection, the sheet 9 is pulled against the resistance, caused by the suction openings 8 of the rotating suction plate 2' which urge the sheet towards the side stops 5', in a direction towards the side stops 5, whereby the sheet is tensioned. In this way, the arriving sheet 9, which is drawn in dash-dot lines, comes into the registered position illustrated with dash-double-dot drawn lines against the front and side stops with simultaneous tensioning of the sheet 9 preventing arching.

Figure 2:
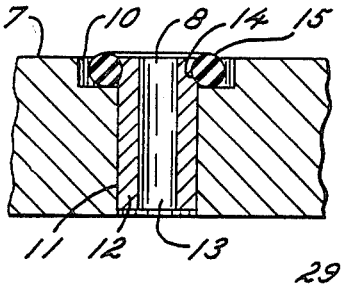
FIG. 2 is a partial section of the suction plate shown in FIG. 1.

In the partial section illustrated in FIG. 2 of the suction plate in the region of the suction opening 8 there is formed in the suction plates 2 or 2' a stepped bore, the wider step 10 of which opens in the plate plane 7.

In the small step 11 leading to the underside of the suction plate 2 or 2', there is set, e.g. with a press fit, a bush 12 with a through bore 13.

At its region projecting into the large step 10, the bush 12 is provided at its cylinderical outer surface with a radially surrounding groove 14, in which is set a rubbery elastic O-ring. This O-ring, to the shape of which the groove 14 is substantially matched, projects radially outwardly into the large step 10. In the axial direction, the large step 10 has a somewhat lower depth than the diameter of the O-ring 15, so that this projects somewhat into the plate plane 7. The diameter of the large step 10 is so large that the O-ring can be taken out from its installed position first radially from the groove 14 and then axially from the plate plane 7. This makes possible a simple mounting and demounting of the O-ring 15 e.g. in the case of wear.

Figure 3:
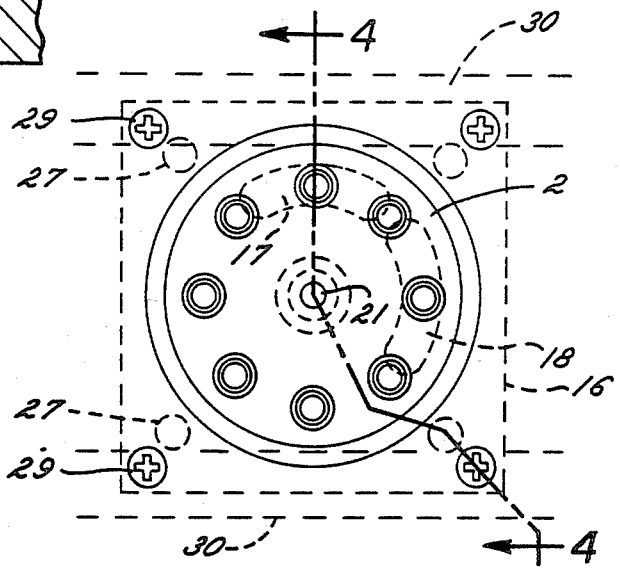
FIG. 3 is a top view of a particular embodiment of the suction plate and showing means for selectively applying suction to the suction openings located relative to the feed direction and in a transverse direction.

Turning now to FIGS. 3 and 4, there is shown a specific embodiment of the suction plate 2, and means for selectively applying suction to the suction openings located relative to the feed direction either to the rear outward facing quadrant or to the suction openings located relative to the feed direction in the front inward facing quadrant. As more clearly shown in FIG. 4, the suction plate 2 lies upon a base plate 16 having milled therein two arcuate manifolds 17, 18 which are aligned with the rear outward facing quadrant and the front inward facing quandrant, respectivley. Therefore, suction is selectively applied to the suction openings 8 which register with the manifolds 17, 18. Each manifold is separately connected to a source of suction via a flexible hose 19 clamped to a threaded connector tube 20 mounted in the base plate 16 and providing a suction connection between the respective manifold and the hose.

For selectively rotating the suction plate 2, the suction plate is force fitted to a shaft 21 which is journalled to the base plate 16 via a bearing 22. The shaft 21 is coupled via a connector 23 to the shaft 24 of a stepper motor 25. The connector 23 has set screws 26 which are selectively engaged with the respective shafts so that the suction plate 2 is flush with the base plate 16. The stepper motor 25 is mounted to the base plate 16 via cylindrical standoffs 27 and machine screws 28. So that the upper surface of the suction plate 2 is flush with the upper surface of the feed table 1, the base plate 16 is clamped to the feed table via flat head screws 29. Moreover, to support the weight of the stepper motor 25, the base plate 16 is received in angle rails 30 which extend beneath the sheet feed table 1 in the transverse direction relative to the sheet feed direction.

Turning now to FIG. 5, there is shown an alternative embodiment wherein a suction plate 31 is mounted above a sheet feed table 1'. The construction is similar to that shown in FIGS. 3 and 4, except that a base plate 32 is slidably mounted between two rails 33, 34 which are mounted above the sheet feed table 1' and extend in the transverse direction relative to the sheet feed direction 3. To receive fed sheets (not shown), an angled rail 35 is mounted to the rail 33 to direct the leading edge of the sheets to the gap between the suction plate 31 and the sheet feed table 1'. To independently adjust the position of the suction plate 31 transversely to the feed direction, there is provided a clamp 36 which engages the rail 34 and the base plate 32 to fix the position of the base plate when a machine screw 37 is tightened.

Turning now to FIG. 6, there is shown a schematic diagram of a system for selectively rotating a left suction plate 2 and a right suction plate 2' in synchronism either continuously or in step with a sheet feeder drive 38, and to selectively register the fed sheet (not shown) with either the left-hand side stops 5 or the right-hand side stops 5'. To subject the suction plates 2, 2' to suction in time with the rhythm of the sheet feeder drive 38, the respective suction hoses generally designated 19 are provided with respective solenoid valves 39. The valves are preferably of the kind which are closed unless their respective solenoids are energized. The solenoid valves leading to the rear outward facing quadrants 17 are both energized by a first cam operated switch 40 and the solenoid valves leading to the front inward facing quadrants 18 are selectively energized by a second cam operated switch 41. The switches sense the proximity of respective cam lobes on cam disks 42, 43, rotated by the sheet feeder drive 38.

When energized, the solenoid valves 39 leading to the manifolds 18 in the inward facing quadrants are supplied with a source of relatively low suction which is adjusted by a series throttle valve 44 and a shunt throttle valve 45 opening to the atmosphere. The manifolds 17 in the outward facing quadrants are selectively connected via the solenoid valves 39 to a switching valve 46 providing means for reversing a connection of relatively high suction to the manifold 17 in the outward quadrant of either the left-hand suction plate 2 or the right-hand suction plate 2'. The relatively high source of suction is provided by a centrifugal pump 47.

To drive the suction plates 2, 2' in synchronism in opposite rotational directions, the respective stepper motors driving the suction plates are connected to a stepper motor drive 48. To control the direction of rotation of the stepper motors 25 (see FIG. 4) each stepper motor has two phase windings activated via respective input leads. These two input leads are connected to the respective phase 1 ($\Phi_1$) and phase 2($\Phi_2$) outputs of the stepper motor drive 48. Reversal of the phases applied to these input leads causes reversal of the direction of rotation of the stepper motor. The input leads of the two different stepper motors driving the left-hand suction plate 2 and the right-hand suction plate 2' are connected with reverse polarity to the two phase outputs of the stepper motor drive 48 so as to obtain the oposite directions of rotation shown in FIG. 6.

So that the suction plates are selectively driven either continuously or stepwise in synchronism with the sheet feeder drive 38, the stepper motor drive 48 has an enable input (ENA) which is activated by a logical OR gate 49 having inputs receiving signals from the cam operated switches 40, 41 and also receiving a signal from a toggle switch 50. When the toggle switch applies a ground signal to the logic gate 49, the suction plates are rotated in synchronism with the sheet feeder drive 38 at the times that suction is applied to the suction plates. However, when the switch 50 is thrown to its opposite position, a supply voltage +V is applied to the logic gate 49 thereby enabling the stepper drive for continuous rotation of the suction plates 2, 2'.

In view of the above, there has been described an apparatus for laterally registering sheets on the feed table of a sheet treating machine in which the plates act to grasp the respective frontmost sheet of the sheet stream in the region of its edge and move it so that its side edge comes to lie against a selected side stop and its front edge comes to lie against a front stop. Means have been described for mounting the suction plate either flush with the sheet feed table or above the sheet feed table, and means have been shown for selectively adjusting and locking the lateral position of the suction plate to provide for the registration of sheets of various sizes. Moreover, means have been shown for synchronizing the registration of the sheets to the sheet feeder drive in the sheet treating machine so that the sheets can be registered for a particular operation in the sheet treating machine and the source of suction is released after registration to enable the treating of a successively fed sheets.

We claim:

1. In an apparatus for the registration of sheets in a sheet stream feedable on a feed table of a sheet treating machine, said feed table including a first and a second suction plate arranged at a distance one from another at right angles to the feed direction, and the apparatus including means for driving each plate rotatably about an axis arranged perpendicular to the feed table, which plates are provided with suction openings which are evenly distributed on a plane of the plate facing away from the feed table and which suction openings are subjected to air suction, enabling the respective frontmost sheet of the sheet stream to be grasped in the region of its leading edge and enabling the sheet to be moved to lie against a side stop and/or a front stop, the improvement comprising providing means enabling the suction plates to be rotatably driven in opposite rotational senses and providing means for selectively applying suction either to the suction openings located momentarily relative to the feed direction to the rear outward facing quadrants or to the suction openings located momentarily relative to the feed direction in the front inward facing quadrants.

2. The apparatus of claim 1 and including means to subject the suction openings of the first suction plate to suction of greater suction force than that applied to the suction openings of the second suction plate.

3. The apparatus of claim 2 wherein the first suction plate is arranged closer to the side stop than the second suction plate, wherein the first suction plate is drivable in a rotational direction moving the sheet towards the side stop.

4. The apparatus of claim 3 and including side stops adjacent both sides of the down-stream end of the feed table and means for reversing the suction connection to the two suction plates.

5. The apparatus of claim 1 wherein the respective frontmost sheet during approximately a quarter turn of the suction plates is grasped by said suction plates and feedable to lie against the side stop.

6. The apparatus of claim 1 wherein the grasped sheet is movable first with a forward component of movement essentially directed in the feed direction and is then movable with a lateral component directed predominantly to the side stop.

7. The apparatus of claim 1 and including means for driving the suction plates in stepwise rotation.

8. The apparatus of claim 1 and including means for driving the suction plates in continuous rotation.

9. The apparatus of claim 8 and including means for subjecting at least one of the suction plates to suction in time with the rhythm of the sheet treating machine.

10. The apparatus of claim 1 and including means to drive the suction plates in sychronism.

11. The apparatus of claim 1 wherein the suction plates are arranged above the feed table.

12. The apparatus of claim 1 wherein the suction plates are arranged set into the feed table with their working surfaces substantially flush with the surface of the feed table.

13. The apparatus of claim 1 and including means to adjust the position of the suction plates transversely to the feed direction.

14. The apparatus according to claim 1 and including means to adjust the position of the suction plates independently one of another transversely to the feed direction.

* * * * *

UNITED STATES PATENT AND TRADEMARK OFFICE

CERTIFICATE OF CORRECTION

PATENT NO. : 4,693,463

DATED : September 15, 1987

INVENTOR(S) : Adolph Schwebel & Herbert Herrmann

It is certified that error appears in the above-identified patent and that said Letters Patent is hereby corrected as shown below:

On the title page, Item (75) inventor should read

Inventors: Adolph Schwebel, Offenbach am Main;

Herbert Herrmann, Obertshausen/Hausen, both of Fed. Rep. of Germany

Signed and Sealed this

Twenty-fourth Day of May, 1988

*Attest:*

DONALD J. QUIGG

*Attesting Officer*

*Commissioner of Patents and Trademarks*